US006210183B1

(12) United States Patent
Sacarto

(10) Patent No.: US 6,210,183 B1
(45) Date of Patent: Apr. 3, 2001

(54) SPARK PLUG AND SPARK PLUG BOOT COMBINATION

(76) Inventor: Walter E. Sacarto, 1413 S. Broadway, Denver, CO (US) 80210

( * ) Notice: Subject to any disclaimer, the term of this patent is extended or adjusted under 35 U.S.C. 154(b) by 0 days.

(21) Appl. No.: 09/526,642

(22) Filed: Mar. 16, 2000

Related U.S. Application Data

(60) Provisional application No. 60/124,837, filed on Mar. 17, 1999.

(51) Int. Cl.[7] ..... H01R 13/44
(52) U.S. Cl. ..... 439/127; 439/784
(58) Field of Search ..... 439/127, 125, 439/126, 128, 805, 784

(56) References Cited

U.S. PATENT DOCUMENTS 3,128,139 * 4/1964 Estes ..... 439/126

* cited by examiner

*Primary Examiner*—Neil Abrams
*Assistant Examiner*—Javaid Nasri

(74) *Attorney, Agent, or Firm*—Edwin H. Crabtree; Ramon L. Pizarro; Donald W. Margolis

(57) ABSTRACT

An improved spark plug and spark plug boot combination used with an internal combustion engine. The spark plug and spark plug boot combination provide for ease in securing the spark plug boot to the spark plug when the spark plug is mounted on the engine. Also, the plug and boot combination provide for ease in removing the spark plug boot from the spark plug which heretofore was difficult to remove because of the boot sticking to the sides of the plug. Further, the combination reduces "flash over" and reduces static electricity with improved engine performance and fuel economy. The spark plug includes external threads formed in a ceramic housing of the plug. The boot includes internal threads formed inside a boot housing for releasable engagement of the external threads on the ceramic body of the spark plug. The boot also includes a spark plug wire connector having "snap-in" connector ribs. The connector ribs are used for releasable receipt in one end of the boot housing. The connector has a plug wire swivel in a connector housing which allows a spark plug wire to be pivoted on the spark plug wire connector when the boot is attached to the spark plug or removed from the spark plug. Along the exterior sides of the boot are longitudinal splines which are used for gripping the boot during installation and removal from the spark plug.

12 Claims, 1 Drawing Sheet

SPARK PLUG AND SPARK PLUG BOOT COMBINATION

This application is based on a Provisional Patent Application filed on Mar. 17, 1999, Ser. No. 60/124,837, having a title of "SPARK PLUG AND SPARK PLUG BOOT COMBINATION" by the subject inventor.

BACKGROUND OF THE INVENTION (a) Field of the Invention

This invention relates to spark plugs and spark plug boots and more particularly, but not by way of limitation, to an improved spark plug and spark plug boot combination for improved engine performance and ease in installation and removal of the plug and removal of the boot from the plug.

(b) Discussion of Prior Art

Today's vehicles have larger and larger engines with various engine accessories mounted on top and on the sides of the engines. This situation leaves little room for installing spark plugs in the engine block along with attaching spark plug boots with spark plug wires to the end of the sparks spark plugs. One vehicle manufacture provide "no" room for changing out spark plugs and the engine literally has to be removed to the engine mounts in order to change spark plugs.

There is a wide variety of spark plugs on today's market for different models and manufactures of vehicle engines. Also, there are different designs of spark plug boots and spark wire terminals for connecting spark plug wires to the spark plugs. None of the prior art spark plug manufactures have addressed a problem of a spark plug boot, over a period of time, sticking to the sides of a spark plug making it difficult to remove the boot from the plug. Further, spark plug manufactures have not addressed a problem of threading a spark plug boot on a spark plug when there is little room for installation next to the engine.

The subject invention addresses the problem of limited working space when working on a vehicle engine and installing spark plug boots on spark plugs and removing spark plug boots from the plugs.

SUMMARY OF THE INVENTION

In view of the foregoing, it is a primary object of the subject invention to provide an improved spark plug and spark plug boot combination used with an internal combustion engine for overall improved engine performance.

Another object of the invention is the new spark plug and spark plug boot combination provides for ease in snugly securing the spark plug boot to the spark plug when space is limited next to the engine.

Still another object of the plug and boot combination is to provide for ease in removing the spark plug boot from the spark plug which heretofore was difficult to remove because of the boot sticking to the sides of the plug.

A further object of the invention is the plug and boot combination reduces "flash over" and static electricity with improved engine performance and fuel economy.

Yet another object of the invention is the spark plug boot includes a plug wire connector with plug wire swivel which allows a spark plug wire to swivel on the plug wire connector for ease in attaching the boot to the spark plug when working in tight conditions. The plug wire connector also includes quick release snap-in connector ribs for releasing the plug wire connector from an end of the spark plug boot.

The spark plug and spark plug boot combination includes a spark plug having external threads formed in a ceramic housing of the plug. The boot includes internal threads formed inside a boot housing for releasable engagement of the external threads on the ceramic body of the spark plug. The boot also includes a spark plug wire connector having "snap-in" connector ribs. The connector ribs are used for releasable receipt in one end of the boot housing. The connector has a plug wire swivel in a connector housing which allows a spark plug wire to be pivoted on the spark plug wire connector when the boot is attached to the spark plug or removed from the spark plug. Along the exterior sides of the boot are longitudinal splines which are used for gripping the boot during installation and removal from the spark plug.

These and other objects of the present invention will become apparent to those familiar with spark plugs, spark plug boots and spark plug wire terminals used with internal combustion engines when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
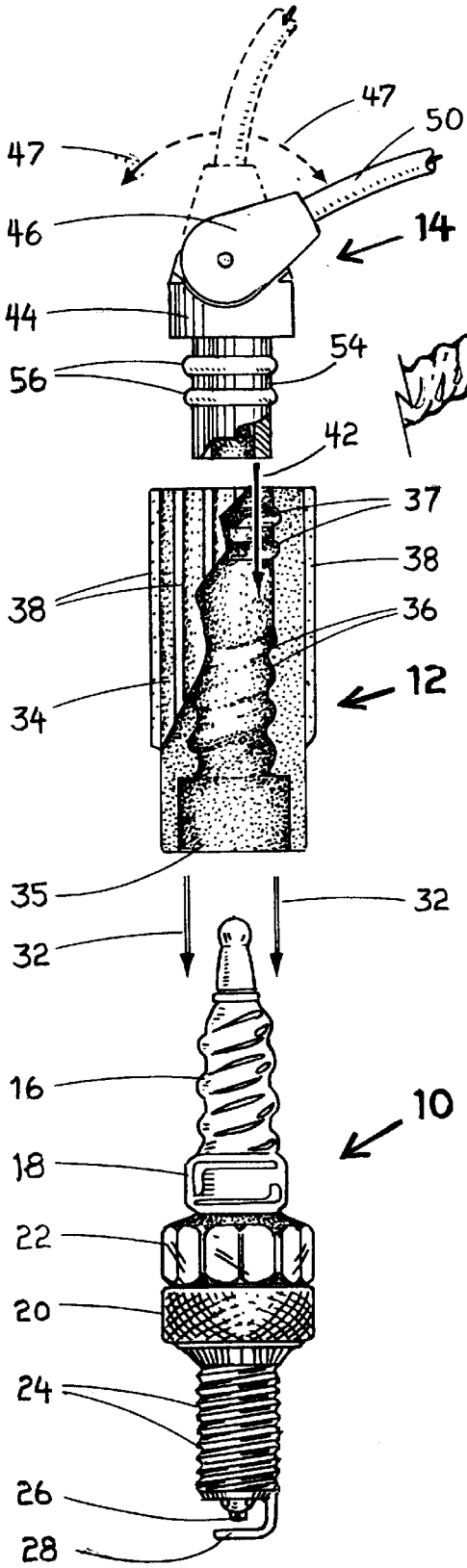
FIG. 1 is a perspective view of the new spark plug with external threads formed in a ceramic housing of the spark plug. A spark plug boot is positioned above the spark plug with a portion of the spark plug boot cut away to expose internal boot threads for engaging the external threads in the ceramic housing. Disposed above the spark plug boot is a spark plug wire connector positioned for connection in an upper end of the spark plug boot.

In FIG. 1, a perspective view of a new spark plug having general reference numeral 10 is illustrated with a spark plug boot having a general reference numeral 12 position above the spark plug 10. Also illustrated in this drawing is a spark plug wire connector 14 disposed above the spark plug boot 12 and positioned for connection thereto.

The new spark plug 10 is characterized by having four-lead threads 16 in a ceramic housing 18 of the spark plug 10. The spark plug 10 also includes a metal housing 20 with a twelve-point nut 22 therearound for threading engine block threads 24 into an engine block. The engine block is not shown in the drawings. Further, the spark plug 10 includes an electrode 26, electrode ground 28 and spark plug cap 30.

The new spark plug boot 12 is shown positioned above the spark plug 10 and ready for threading onto the ceramic body 18 as indicated by arrow 32. A portion of a spark plug boot housing 34 with housing opening 35 has been cut away to expose four-lead internal boot threads 36 around the sides of the opening 35. Also around an upper portion of the sides of the opening 35 are a pair of internal grooves 37. The internal boot threads 36 are used for engaging the four-lead external threads 16 on the ceramic housing 18 and snugly securing the spark plug boot 12 on the spark plug 10. It should be mentioned that heretofore, a prior art spark plug boot was received around the ceramic body of a spark plug in a press fit. With time, the inside of the boot would adhere to the spark plug and when changing the spark plug, the boot would be difficult to remove.

When using the subject invention, the spark plug boot 12 is threaded onto the spark plug 10 for ease in a secure fit when installing the boot. Also, the threaded spark plug boot 12 provides for ease in removing the boot 12 from the spark plug 10. Further, the threading of the spark plug boot 12 onto the spark plug 10 reduces spark plug "flashover" thereby improving the plug performance. The boot 12 also includes a plurality of longitudinal splines 38 along the length of the boot housing 34. The splines 38 are used for gripping the sides of the boot 12 and rotating the boot when removing it from the spark plug 10.

Disposed above the spark plug boot 12 is the spark plug wire connector 14. The connector 14 is positioned for connection in an upper end 40 of the spark plug boot 12 as indicated by arrow 42. The connector 14 includes a connector housing 44 with a plug wire swivel 46 pivotally mounted thereon as indicated by arrows 47. The plug wire swivel 46 is attached to a lower end 48 of a spark plug wire 50. The lower end 48 of the spark plug wire 50 is attached to a plug wire terminal 52 which is received around a top portion of the spark plug cap 30. The plug wire terminal 52 is received insides a lower portion 54 of the connector housing 44. The plug wire terminal 52 is shown in FIG. 2.

The lower portion 54 of the connector housing 44 includes a pair of external ribs 56 therearound which are used for a quick release connection inside the upper end 40 of the boot housing 34. The external ribs 56 of the connector housing 44 are secured in a press fit in the internal grooves 37 of the boot housing 34.

Figure 2:
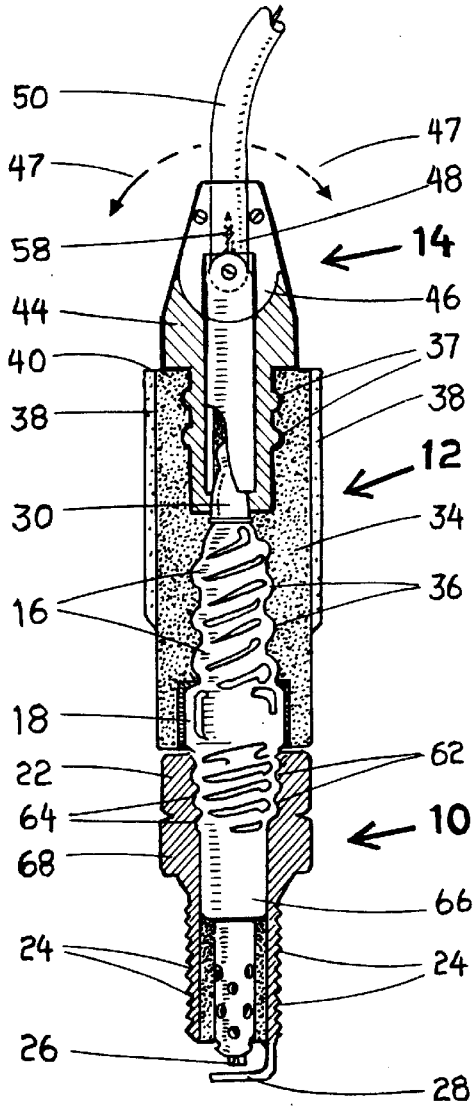
FIG. 2 is a front cut away view of the spark plug boot attached to the sides of the ceramic housing of the spark plug. Also, a portion of the spark plug wire connector is shown cut away and received in the upper end of the spark plug boot. A spark plug wire terminal is shown attached to a spark plug cap of the spark plug for making an electrical connection to the spark plug.

In FIG. 2, a front cut-away view of the spark plug boot 12 is illustrated and attached to the sides of the ceramic housing 18 of the spark plug 10. Also, a portion of the spark plug wire connector 14 is shown cut-away and received in the upper end 40 of the spark plug boot 12. In this view, the spark plug wire terminal 52 is shown attached to the spark plug cap 30 of the spark plug 10 for making an electrical connection from the spark plug wire 50 to the spark plug 10. The terminal 52 includes an internal threaded screw 58 for securing the lower end 48 of the spark plug wire 50 thereto. The plug wire swivel 46 is designed to rotate the spark plug wire 50 on the terminal 52 and allow the spark plug wire 50 to be rotated upward to 180 degrees on the connector housing 44 for ease in working in tight conditions when installing or removing the spark plug boot 12.

Also shown in FIG. 2, is the metal housing 20 of the spark plug 10 cut-away to expose the entire length of the ceramic housing 18. A lower portion 60 of the ceramic housing 18 includes external buttress threads 62 for threaded attachment to internal threads 64 around an opening 66 in the metal housing 20. When the external buttress threads 62 are secured to the internal threads 64 in the metal housing, a ceramic epoxy is applied under pressure through a fill port 68 in the side of the metal housing 20. In this manner, the metal housing 20 is securely attached to the ceramic housing 18 and spark plug "flash over" and radio static is reduced.

Figure 3:
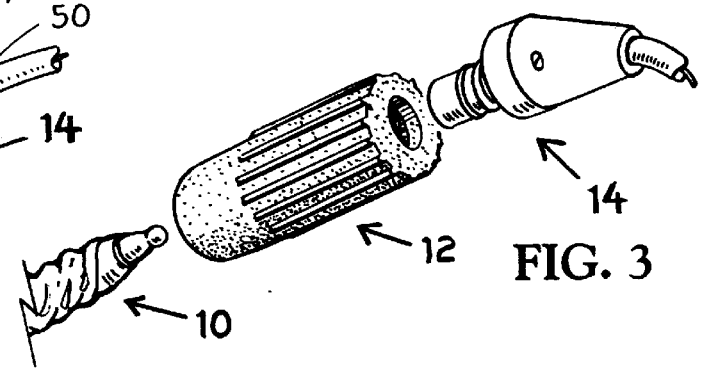
FIG. 3 is a perspective view of the subject invention.

In FIG. 3, a perspective view of the spark plug 10, the spark plug boot 12 and the spark plug wire connector 14 are illustrated.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. An improved spark plug and spark plug boot combination used with an internal combustion engine, the combination comprising:

a spark plug having external threads formed in a ceramic housing of said plug; and a spark plug boot with spark plug boot housing, said boot housing having an opening therethrough, a side inside the opening having internal threads formed therein, said internal threads releasably engaging said external threads on said ceramic body of said spark plug.

2. The combination as described in claim 1 further including a spark plug wire connector with connector housing, said connector housing having "snap-in" connector ribs, said connector ribs adapted for releasable receipt in an upper end of said boot housing.

3. The combination as described in claim 2 wherein said boot housing includes a plurality of internal grooves in the side of the opening, said connector ribs releasably attached to said internal grooves.

4. The combination as described in claim 2 further including a plug wire swivel mounted on top of said connector housing, said plug wire swivel allowing a spark plug wire to be pivoted on top of said connector housing when said spark plug boot is attached to said spark plug.

5. The combination as described in claim 4 wherein said connector housing includes a plug wire terminal mounted therein, said plug wire terminal connected to said spark plug wire, said plug wire terminal releasably connected to said spark plug.

6. The combination as described in claim 1 wherein said spark plug boot includes longitudinal splines disposed along a length of said boot, said splines used for gripping said boot during installation and removal from said spark plug.

7. An improved spark plug and spark plug boot combination used with an internal combustion engine, the combination comprising:

a spark plug having external threads formed in a ceramic housing of said plug;

a spark plug boot with spark plug boot housing, said boot housing having a lower end and an upper end, said boot housing having an opening therethrough, a side inside the opening at the lower end of the boot housing having internal threads formed therein, said internal threads releasably engaging said external threads on said ceramic body of said spark plug, a side inside the opening at the upper end of the boot housing having a plurality of internal grooves; and a spark plug wire connector with connector housing, said connector housing having "snap-in" connector ribs, said connector ribs releasably engaging the internal grooves in the upper end of the boot housing.

8. The combination as described in claim 7 further including a plug wire swivel mounted on top of said connector housing, said plug wire swivel allowing a spark plug wire to be pivoted on top of said connector housing when said spark plug boot is attached to said spark plug.

9. The combination as described in claim 8 wherein said connector housing includes a plug wire terminal mounted therein, said plug wire terminal connected to said spark plug wire, said plug wire terminal releasably connected to said spark plug.

10. An improved spark plug and spark plug boot combination used with an internal combustion engine, the combination comprising:

a spark plug having external threads formed in a ceramic housing of said plug;

a spark plug boot with spark plug boot housing, said boot housing having a lower end and an upper end, said boot housing having an opening therethrough, a side inside the opening at the lower end of the boot housing having internal threads formed therein, said internal threads releasably engaging said external threads on said ceramic body of said spark plug, a side inside the opening at the upper end of the boot housing having a plurality of internal grooves;

a spark plug wire connector with connector housing, said connector housing having "snap-in" connector ribs, said connector ribs releasably engaging the internal grooves in the upper end of said boot housing; and a plug wire swivel mounted on top of said connector housing, said plug wire swivel allowing a spark plug wire to be pivoted on top of said connector housing when said spark plug boot is attached to said spark plug.

11. The combination as described in claim 10 wherein said connector housing includes a plug wire terminal mounted therein, said plug wire terminal connected to said spark plug wire, said plug wire terminal releasably connected to said spark plug.

12. The combination as described in claim 10 wherein said spark plug boot includes longitudinal splines disposed along a length of said boot, said splines used for gripping said boot during installation and removal from said spark plug.

* * * * *